United States Patent [19]

Haftmann et al.

[11] Patent Number: 4,948,276

[45] Date of Patent: Aug. 14, 1990

[54] TYPEWRITER, PRINTER OR THE LIKE AND RIBBON CASSETTE THEREFOR

[75] Inventors: Johannes Haftmann, Schwabach; Rudolf Schmeykal, Hemhofen, both of Fed. Rep. of Germany

[73] Assignee: TA Triumph-Adler Aktiengesellschaft, Nuremberg, Fed. Rep. of Germany

[21] Appl. No.: 363,979

[22] Filed: Jun. 9, 1989

[30] Foreign Application Priority Data

Jun. 10, 1988 [DE] Fed. Rep. of Germany ..... 3819782

[51] Int. Cl.[5] ..... B41J 35/28

[52] U.S. Cl. ..... 400/208; 400/247; 400/223; 101/336

[58] Field of Search ..... 400/207, 208, 212, 241, 400/245, 247, 249, 225, 223, 242; 101/336

[56] References Cited

U.S. PATENT DOCUMENTS

| | | | |
|---|---|---|---|
| 4,416,161 | 11/1983 | Barkholidarian | 324/209 X |
| 4,425,046 | 1/1984 | Van Horne et al. | 400/208 |
| 4,503,391 | 3/1985 | Hinke | 324/208 |
| 4,591,788 | 5/1986 | Mohri et al. | 324/260 |
| 4,624,588 | 11/1986 | Bivin | 400/225 X |
| 4,639,670 | 1/1987 | Normann | 324/260 |
| 4,655,624 | 4/1987 | Kondo et al. | 400/208 |
| 4,779,075 | 10/1988 | Zagelein et al. | 324/207 X |
| 4,797,016 | 1/1989 | Lahr | 400/225 X |
| 4,797,018 | 1/1989 | Hoffmann et al. | 400/249 |

FOREIGN PATENT DOCUMENTS

| | | | |
|---|---|---|---|
| 61-22972 | 1/1986 | Japan | 400/225 |

*Primary Examiner*—Edgar S. Burr
*Assistant Examiner*—Motilal P. Patel
*Attorney, Agent, or Firm*—Browdy and Neimark

[57] ABSTRACT

In an electronically controlled typewriter, a printer or the like with an exchangeable ribbon cassette, which is provided with identifying codings and where the ribbon cassette is pivotable between a lowered position of rest and an elevated printing or operating position around the cassette base facing away from the printing area, it is provided in order to attain a simple and dependably readable coding which can discriminate between a plurality of different types of ribbon cassettes, that at a defined radial distance from the base of the ribbon cassette, which is to be inserted, a sensor is disposed at the side of the pivot path of the same, which gives off an electrical output signal in reference to a changing magnetic field. It is provided in a ribbon cassette for such a typewriter or such a printer to dispose at least one bistable magnetic element on a lateral surface of the ribbon cassette.

5 Claims, 1 Drawing Sheet

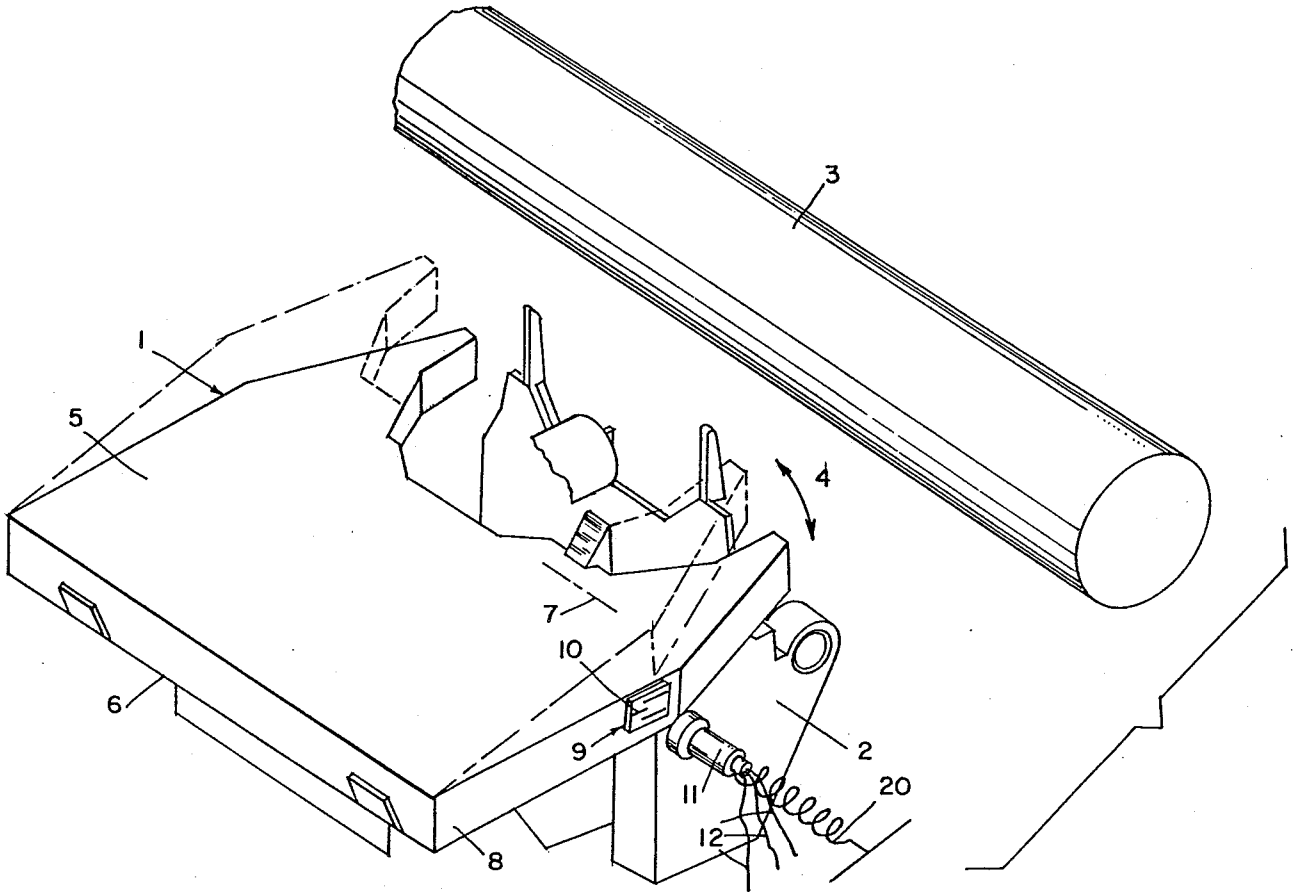
3
4
2
20
12
11
10
9
7
8
1
5
6

TYPEWRITER, PRINTER OR THE LIKE AND RIBBON CASSETTE THEREFOR

FIELD OF THE INVENTION

The invention relates to an electronically controlled typewriter, printer or the like with an exchangeable ribbon cassette provided with identifying coding, the ribbon cassette being pivotable between a lowered position of rest and an elevated printing or work position around the cassette base facing away from the printing area, and to a ribbon cassette with suitable coding.

BACKGROUND OF THE INVENTION

Such a typewriter or ribbon cassette is known from German Pat. No. DE-PS 31 53 263. In this ribbon cassette, a window is provided in a wall of a guide arm for the ribbon, through which the ribbon contained in the cassette housing is visible. At the same time, an optical marking is provided above the window on the outer wall of this guide arm. A reflecting light barrier is disposed in front of the marking or of the window, which in the lowered position of rest scans the optical coding and in the elevated printing position scans the ribbon itself through the window. It is possible in this manner to obtain with one and the same sensor information regarding the type of cassette used by means of the optical coding and information regarding the proximity to the end of the ribbon by scanning the ribbon. For this purpose a reflecting foil, for example, may be disposed in the area of the end of the ribbon by means of which the intensity of the reflected light beam is suddenly increased.

Although the known device for the determination of the end of the ribbon is quite adequate, it is nevertheless not satisfactory because in this manner only two different types of cassettes can be recognized, depending on whether the optical coding has been made strongly reflective or weakly reflective.

However, with printers and typewriters having ribbon cassettes there is the definite requirement of collecting very different types of information regarding the type of ribbon prior to the start of the printing process in order to prevent the use of a ribbon not intended or suitable for a desired purpose, or a lack of suitability of the control of the typewriter or printer regarding the ribbon used.

For example, a so-called single-use ribbon can only be used one time and therefore is advanced by a set distance after each printing step which approximately corresponds to the width of the character. With multiple-print ribbons the advance corresponds to only one half or one third of the width of the character to be printed, therefore the electronically controlled advance depends on the type of ribbon used. Additionally, there is a requirement, for example in banking, of only using indelible ribbons, so that it should also be possible to sense whether the ribbon used is one of that type. If it is not the case, the use of such an unsuitable ribbon cassette must be prevented by the control of the typewriter.

SUMMARY OF THE INVENTION

Based on the foregoing it is an object of the invention to provide a coding on the ribbon cassette, in particular as to its type, which makes it possible to distinguish a plurality of different cassette types and which can be produced simply and cost-effectively while assuring reliable recognition.

This object is attained by means of the invention in that at a defined radial distance from the base of a ribbon cassette to be used in a typewriter, a printer or the like, a sensor is disposed laterally to the pivot path of the cassette, which emits an electrical output signal in reference to a changing magnetic field. The sensor is placed in such a way that a magnetic coding disposed on the ribbon cassette, which generates a changing magnetic field, is transported across the sensor in its entire length.

By the use of a plurality of different magnetic elements for coding a characteristic pulse sequence can be generated in the course of moving so that it becomes possible to determine the types of a plurality of different ribbon cassettes in conjunction with a suitable evaluation and memory device within the typewriter. A defined characteristic pulse sequence is assigned to each type of ribbon cassette which is stored in the typewriter or printer. When a pulse sequence detected by the sensor coincides with a stored pulse sequence, the cassette used is recognized and, depending on its suitability, use of the same is either made possible or prevented, or the control of the typewriter is set to agree with the respective ribbon cassette.

If the coding has not yet been recognized in the course of the first pivot movement, i.e. if it is not possible to assign the pulse sequence detected by the sensor to a stored pulse sequence, it may also be provided to design the control in such a way that, after insertion, several lowering and elevating movements of the cassette are performed, until a sure determination has been made.

Thus the invention is based on the fundamental idea to use the pivot movement of the cassette made for attaining two different operational states, which takes place anyway, to generate a characteristic pulse sequence. The advantage of such a readable magnetic coding lies on the one hand in the ability to recognize a plurality of different types of cassettes and, on the other hand, in that such a coding is completely impervious to the effects of stray light or dirt.

In a further embodiment of the invention it is provided that the sensor is disposed at the height of a lateral surface of a ribbon cassette to be inserted and spring-loaded in the direction towards said lateral surface. This results in a satisfactory direct contact between the sensor and the coding provided there, so that dependable triggering, free of interference signals, is achieved.

The invention is also directed to a ribbon cassette for an electronically controlled typewriter of the type described above. It is provided in such a ribbon cassette to dispose on a lateral surface at least one bistable magnetic element. Such magnetic element is, in the simplest case, a permanent magnet, the longitudinal axis of which may, depending on the way the magnet has been inserted, have two different orientations relative to the direction of movement of the cassette in the course of a pivot movement during which the reading of the coding takes place and in this way generates a positive or negative electrical signal during the passing movement, making identification possible. By means of a succession of such strip-like magnets a code can be generated which may consist of a succession of positive and negative signals. However, bistability of the magnetic element may also be realized, independent of its orientation, by different stable magnetized states, different signal strengths being created depending on magnetization and the sequence of different signal strengths, resulting in a code which can be analyzed by means of a corresponding discrimination circuit.

In a ribbon cassette having a generally rectangular basic shape of the customary type it is advantageously provided to dispose the bistable magnetic element in the area of the upper edge on a lateral surface of the approximately rectangular basic body. Thus it is accomplished on the one hand to dispose the magnetic element laterally at the very outside of the basic body and, on the other hand, that it is at the maximal radial distance during the pivot movement around the cassette base formed by a longitudinal edge of the rectangular basic body. This not only results in a maximally large movement distance, which improves resolution during scanning, but the pivot movement in this area is also nearly linear, so that analysis is not hampered by the superimposition of a pivot movement.

Advantageously the bistable magnetic element is in the form of a so-called Wiegand wire. Such wires are made of ferromagnetic alloys. They are treated during manufacture in such a way that they have an exterior zone of magnetic hardness and an interior zone of relative magnetic softness. Shell and core orient themselves in the same direction under the influence of a strong magnetic field. If an element made of such a wire is inserted into a magnetic field having reverse polarity but lesser field strength, the magnetically soft core is reversely magnetized and only when a higher magnetic field of reverse direction is provided, is the outer zone reversely magnetized. Accordingly, four different magnetized states can be realized with such a wire element, depending on the magnetic pretreatment, by either magnetizing the exterior and interior zone evenly in a first direction, or in that the interior and exterior zones have different magnetized directions opposite to each other or finally, that both the exterior and the interior zones ar magnetized in a second direction in relation to the longitudinal axis of the element. By means of a coil placed on such a wire element or positioned in its vicinity, the respective polarities can be determined, with the coil generating voltage pulses. Accordingly, such a coil may serve as a sensor on the machine for reading a coding using such Wiegand wire elements. It is clear from the above that because of the four possible different magnetized states of only a single such element, four different types of ribbon cassettes can be determined. By combining several elements and a corresponding signal sequence during passage, it is possible to realize a considerably greater number of different codings.

An important advantage of these Wiegand elements consists in that the magnetic data can be disposed on a relatively limited area because of which the magnetisation of the wire can be definitely read in this manner during the pivot movement. Such Wiegand elements have been described in more detail in, for example, the journal "TM", Vol. 51, No. 4, Apr. 1984.

BRIEF DESCRIPTION OF THE DRAWING

Further characteristics, advantages and details of the invention ensue from the following description of a preferred embodiment by means of the drawing, in which:

The drawing is a schematic, perspective view of a ribbon cassette according to the invention inserted into a typewriter according to the invention.

DETAILED DESCRIPTION OF THE PREFERRED EMBODIMENT

The drawing shows a ribbon cassette 1 inserted into a typewriter, not shown in detail, having a carriage 2 and a platen 3.

The ribbon cassette can be moved back and forth in the direction of the double arrow 4 by means of a mechanism, also no shown, between a position of rest shown by solid lines and a printing position shown by dash-dotted lines.

The cassette has a basic body 5 of approximately rectangular shape, the pivot movement taking place around the base 6, i.e. the lower longitudinal edge of the basic body 5 of the cassette 1.

In the area of the opposite upper longitudinal edge 7 of the basic body 5, a coding 9 is disposed on a lateral surface 8 of the cassette 1, which is formed by a plurality of bistable magnetic elements, three Wiegand wires 10 in the exemplary embodiment.

Immediately adjacent to this coding 9, approximately in the center of its pivoting, a sensor 11 in the form of a coil is fastened on the typewriter and is connected via wires 12 with an analysis device not shown in detail. The sensor 11 is loaded by means of a spring, also not shown, in the direction towards the coding 9, thus assuring in all cases that, when the ribbon cassette 1 has been inserted, the sensor 11 rests directly on the coding 9 sensor 11 is pushed towards cassette 1 by a spring 20.

During the pivot movement of the cassette 1 in the course of movement from the position of rest into the printing position, the coding 9, i.e. the Wiegand wire elements 10 disposed there in the longitudinal direction of the lateral surface 8, is moved along the coil of the sensor 11, at which time, depending on the orientation and the degree of magnetization a sequence of pulses, possibly of different intensity and different sign, is generated in the coil and analyzed in the evaluation element or analysis device.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

What is claimed is:

1. An electronically controlled printer having an exchangeable ribbon cassette having a base comprising in combination:

an identifying magnetic coding including at least one bistable magnetic element located at a defined radial distance from a pivot path on said cassette;

said pivot point being located on said cassette base facing away from the printing area;

means for pivoting said cassette between a lowered position of rest and an elevated printing or work position and for pivoting around said pivot point on said cassette;

a sensory means disposed at said defined radial distance from cassette pivot point, and disposed upon a portion of said printer other than said cassette;

wherein said sensory means is located adjacent to said identifying coding on said cassette; and wherein an electrical output signal is generated in response to the movement of said identifying coding with respect to said sensor which senses a changing magnetic field.

2. A printer in accordance with claim 1, wherein the sensor is disposed at the height of said magnetic coding, wherein said coding is located on a lateral surface of said cassette, and said sensory is spring-loaded in the direction toward said lateral surface.

3. A ribbon cassette in accordance with claim 2 wherein said lateral surface lies in a radial plane about said pivot.

4. A ribbon cassette for an electronically controlled printer in accordance with claim 1, wherein said magnetic coding further comprises at least one bistable magnetic element disposed on a lateral surface of the ribbon cassette.

5. A ribbon cassette in accordance with claim 4, wherein said at least one bistable element is a Wiegand wire.

* * * * *